United States Patent [19]

Boeckman et al.

[11] 4,009,600

[45] Mar. 1, 1977

[54] BIT KEY LOCK

[75] Inventors: Maynard A. Boeckman, Kane, Pa.; Richard M. Singer, Lafayette, Calif.

[73] Assignee: Kane Manufacturing Corporation, Kane, Pa.

[22] Filed: Aug. 29, 1975

[21] Appl. No.: 608,835

[52] U.S. Cl. ..... 70/355; 70/409

[51] Int. Cl.[2] ..... E05B 21/00

[58] Field of Search ..... 70/337, 340, 345, 346, 70/347, 353, 354, 355, 356, 409

[56] References Cited

UNITED STATES PATENTS

| | | | |
|---|---|---|---|
| 55,244 | 6/1866 | Corbett | 70/355 X |
| 289,435 | 12/1883 | Moore | 70/355 |
| 306,976 | 10/1884 | Thumshirn | 70/355 |
| 321,306 | 6/1885 | Markham | 70/419 |
| 2,143,425 | 1/1939 | Schuyler | 70/347 X |

OTHER PUBLICATIONS

Charles Tomlinson — Rudimentary Treatise on the Construction of Locks., May 23, 1935, pp. 29–31.

*Primary Examiner*—Robert L. Wolfe

[57] ABSTRACT

A bit key lock is improved by the provision of at least one deadplate fixedly position nonsymmetrically with respect to the lock between tumblers so as to interfere with the turning of any key not allowing for the presence of the deadplate. By reason of the nonsymmetrical positioning of the deadplate, different keys are required to actuate the lock from opposite sides. A master key may be provided by allowing for the alternate position of the deadplate relative to the opposite sides of the lock.

4 Claims, 10 Drawing Figures

BIT KEY LOCK

The invention relates to bit key locks and, more particularly, to an improved bit key lock adapted to be unlocked from one side by a first key; unlocked from the opposite side by a second key having a different configuration than the first key; and unlocked from either side by a master key having a still different configuration from either the first or second keys.

Bit key locks are widely used in prisons, mental hospitals and other institutions where a high degree of security must be maintained. A major use of such locks occurs in connection with security screens used on various types of windows and door closures. To maintain the security of such institutions yet provide outside access in cases of emergencies, it is desirable that the locks for such closures open from either side, but only by the use of different keys.

The present invention has for its object the provision of an improved bit key lock adapted to be unlocked from one side with a first key; from the opposite side with a second key having a different configuration than the first key; and from either side by a master key having a configuration different from either the first or second keys. A further object of the invention is to provide such capability in a bit key lock with a minimum of change in the basic lock construction.

Briefly, and in general, the objects of this invention are achieved by a lock construction in which at least one deadplate is fixedly positioned nonsymmetrically with respect to the lock between two tumblers of the lock. The deadplate has a peripheral edge portion which extends into the normal rotational path of the key so as to block the turning of all keys not allowing for the presence of the deadplate.

Figures 1, 2, 3:
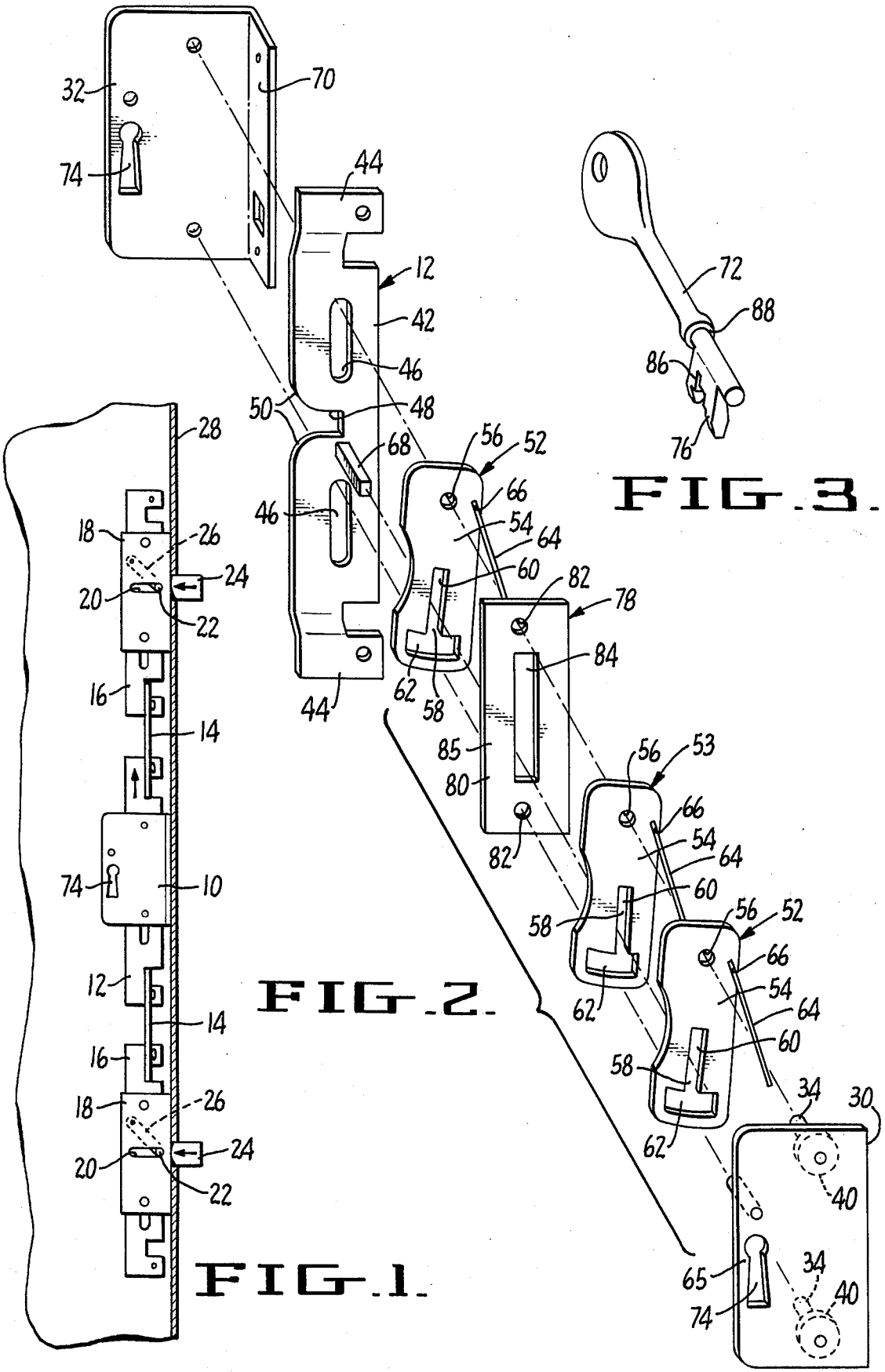
FIG. 1 is a partial, sectional view showing the arrangement of a bit key lock and its accompanying latching mechanism for a security screen closure.
FIG. 2 is an exploded view of a bit key lock made in accordance with the teachings of the present invention.
FIG. 3 is a perspective view of a key for opening the lock.

A typical lock assembly and latching mechanism for a window closure, such as a security screen, is shown in FIG. 1. The lock assembly comprises a two-piece casing or housing 10. A vertically movable slide lever 12 is mounted in the housing 10 and the ends of the slide lever 12 are interconnected by bars 14 with similar vertically movable slide levers 16 mounted in upper and lower latch casings or housings 18. Each latch housing 18 has a lateral slot 20 formed therein to accommodate guide pins 22 on the latches 24. The pins 22 are pivotally connected to the slide levers 16 by links 26 (shown in dotted lines, FIG. 1). Movement of the vertically movable slide lever 12 upwardly (as shown by the arrow, FIG. 1) causes the slide levers 16 to also move upwardly. Upward movement of the slide levers 16 in the latch housings 18 causes the guides 22 in the lateral slots 20 to move inwardly and retract the latches 24 from correspondingly formed openings in the security screen sub-frame jamb (not shown). With the latches retracted in this manner, the security screen for the window closure may be opened. Downward movement of the slide levers 16 in the latch housings 18 causes the guide pins 22 to move outwardly in the lateral slots 20 and causes the latches to again engage the corresponding openings in the security screen sub-frame jamb.

Figure 4:
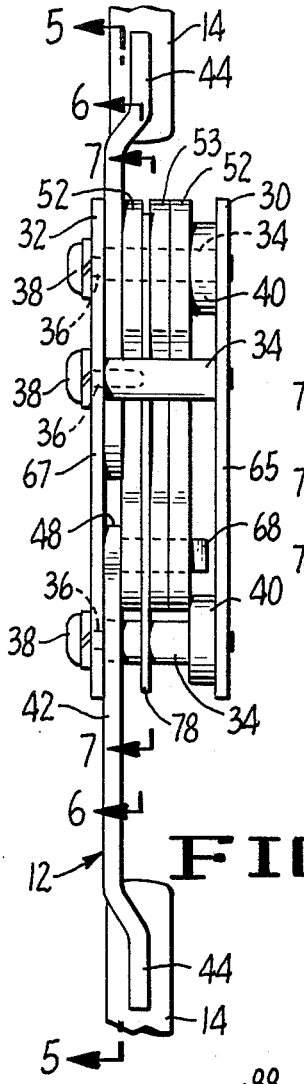
FIG. 4 is a side elevational view of the tumblers and latch operating slide lever of the lock.
Figure 5:
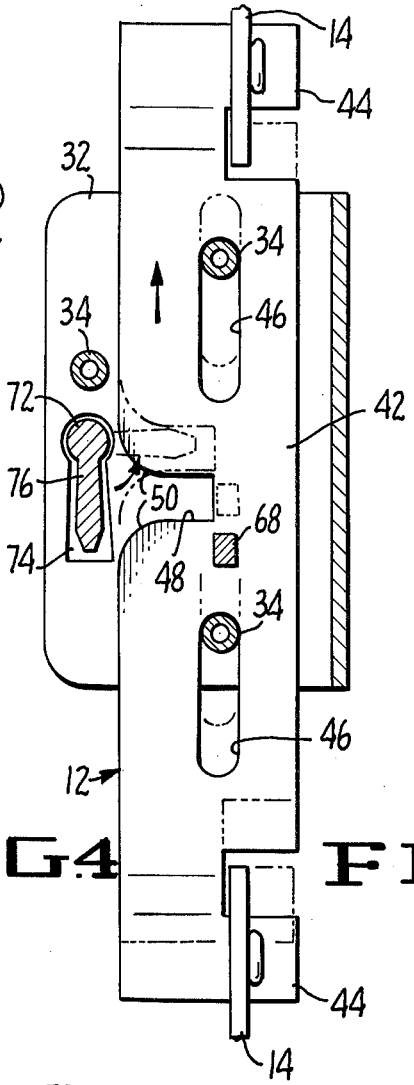
FIG. 5 is a sectional view taken along the line 5—5 in FIG. 4 looking in the direction of the arrows.

As shown in FIGS. 1 and 2, the lock housing 10 comprises a mounting plate 30 and an L-shaped cover 32. Three cylindrical posts 34 are fixedly mounted to the plate 30 and the free ends of the posts are reduced in diameter to form shoulders which serve to accurately space the mounting plate 30 from the cover 32 when the posts are inserted in corresponding openings 36 formed in the cover. The cylindrical posts 34 are internally threaded to receive lockscrews 38 which hold the lock assembly together (see FIG. 4). Two of the posts have flanges 40 at their bases which serve to align the tumblers for the lock.

The vertically movable slide lever 12 comprises a generally rectangular, flat plate 42 with offset ends 44. The lever 12 is formed with two vertical slots 46 which permit the lever plate 42 to be slidably mounted over two of the spacing posts 34. When so mounted, the slide lever 12 may move vertically relative to the spacing posts 34. The slide lever 12 is also provided in its central portion with a lateral slot or indentation 48. The lateral indentation 48 extends approximately midway through the slide lever plate 42 and the outer portions thereof are curved to provide cam surfaces 50 for engagement with the lock key in a manner to be described later.

The lock mechanism includes three tumblers 52, 53, each of which is formed from a flat blank 54 having an opening 56 at one end to permit the blank to be pivotally mounted on one of the spacing posts 34. Each blank 54 is also provided with a T-shaped slot 58 adjacent the end opposite to the opening 56. The configuration of the slot in the two outer tumbler blanks are identical, but the configuration of the slot in the central tumbler 53, however, is slightly different. In the case of the central tumbler blank 53, the base 60 of the slot 58, rather than being centrally located with respect to the crossbar portion 62, is located off-center to one side (see FIG. 2). A leaf spring 64 is provided on each blank 54 by insertion with an angled slot 66 formed in the peripheral edge of the blank. The central tumbler 53 is centrally positioned relative to the key locating outer surfaces 65, 67 on the cover and mounting plate respectively.

Figure 6:
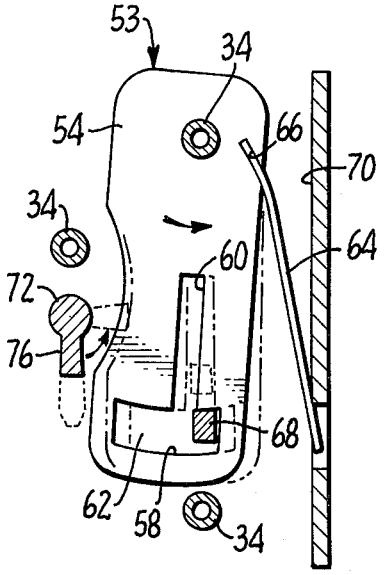
FIG. 6 is a sectional view taken along the line 6—6 in FIG. 4 looking in the direction of the arrows.

When the slide lever 12 and the tumblers 52, 53 are assembled within the lock housing 10, a laterally extending rectangular arm 68 on the slide lever passes through the cross-bar portions 62 of the T-shaped slots 58 in the tumblers. By reason of the tension of the leaf springs 64 against the end surface 70 of the cover 32, each of the tumblers is biased in a clockwise direction so that the arm 68 on the slide lever 12 is positioned at the corners of the T-shaped slots and effectively prevented from vertical movement (see FIG. 6). Insertion of a key 72 to the lock into the keyhole 74 and counterclockwise rotation of the key causes the appropriate portions of the key blade 76 to contact the tumblers 52, 53 and pivot them in a counterclockwise direction around the spacing posts 34. When this is done, the vertical portions 60 of the T-shaped slots 58 in the tumblers 52, 53 are pivoted in a counterclockwise direction and brought into register with the laterally extending arm 68 on the slide lever 42. Further rotation of the blade 76 of the key 72 causes the key to engage the upper cam surface 50 of the indentation 48 in the slide lever 12 and to move the slide member vertically. Vertical movement of the slide lever 12 retracts the latches 24 to permit opening of the window closure 28 in the manner previously described. Locking of the window closure 28 is effected when the key 72 is rotated in a counterclockwise direction. The slide lever 42 is moved downwardly to extend the latches 24 and the tumblers 52, 53 are repositioned in their locking attitude.

Figure 9:
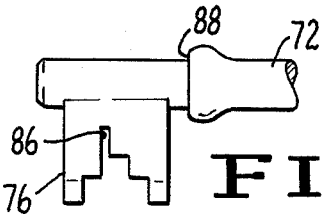
FIG. 9 is a side view of a key showing the configuration required to unlock the lock from the opposite side.

In the preferred embodiment of the invention shown and described herein, at least one deadplate 78 is fixedly positioned nonsymmetrically with respect to the lock. The deadplate 78 may, as shown, take the form of a rectangular plate 80 formed with two circular openings 82 to enable the plate to be mounted on the spacer posts 34. A vertical slot 84 is formed centrally in plate 80, and this slot accommodates the laterally extending arm 68 on slide lever 12. The dimensions of the deadplate 78 are such that the outer peripheral portion 85 of the plate 80 adjacent the keyhole 74 extends within the normal rotational path of the blade 76 of the key 72. By reason of this interference with the key, operation of the lock is prevented unless the blade 76 of the key 72 is notched to avoid contact with the deadplate 78. Accordingly, operation of the lock from the inside (in this case, mounting plate 30 side) when the deadplate 78 is shown in the position of FIG. 2 requires a key with a blade portion 76 having a configuration shown in FIG. 9. It will be observed that the blade portion 76 of the key shown in FIG. 9 has an inner notch 86 which aligns itself with the deadplate 78 when the key is inserted in the keyhole and the locating surface 88 on the key bears against the mounting plate 30.

Figure 8:
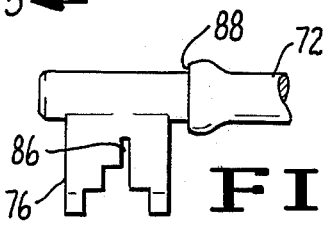
FIG. 8 is a side view of a key showing the configuration required to unlock the lock from one side.
Figure 10:
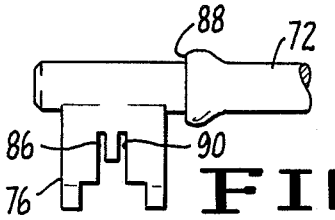
FIG. 10 is a side view of a key showing the configuration required in a master key for unlocking the lock from either side.
Figure 7:
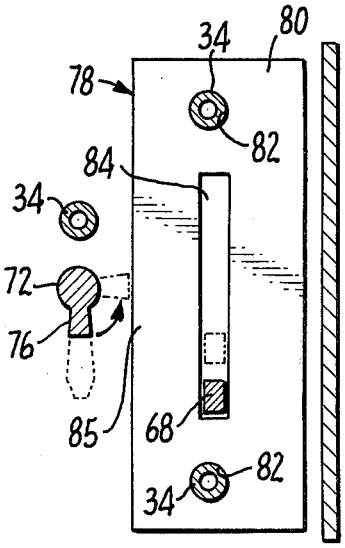
FIG. 7 is a sectional view taken along the line 7—7 in FIG. 4 looking in the direction of the arrows.

It will be noted that the lock casing is provided with a keyhole on each side, and this arrangement enables the lock to be operated by a key inserted from the outside as well as from the inside. With the deadplate in the location shown in FIG. 2, it will be seen that a key having a blade portion 76 with the configuration shown in FIG. 8 is required to operate the lock from the outside (cover side). Likewise, a key having the blade configuration shown in FIG. 10 will serve as a master key and will be capable of actuating the lock from either side with the deadplate as shown in FIG. 2. By reason of the double-notching 86, 90 of the key blade 76, the key of FIG. 10 can be inserted from either side to operate the lock.

What is claimed is:

1. In a bit key lock, a mounting plate positioned to serve as one side of a lock housing, a cover positioned to serve as the opposite side of said lock housing, first and second keyholes formed in opposite sides of said housing, mounting posts for securing said mounting plate and cover together in laterally spaced relation, a slide lever mounted between said mounting plate and cover on said mounting posts for reciprocal movement and having a laterally projecting arm and a key-receiving indentation in one edge portion, a plurality of lock tumblers pivotally mounted on a mounting post adjacent said slide lever and between said mounting plate and cover, said tumblers having T-shaped slots formed therein to accommodate the laterally projecting arm on the slide lever, the improvement comprising:

a. at least one deadplate positioned off-center relative to the mounting plate and cover and between two of said lock tumblers, said deadplate having a peripheral portion extending into the lock actuating path of a key, and b. a key that may be selectively inserted through either said first or second keyholes and having a blade portion adapted to engage said slide lever and tumblers, a notch being formed in said blade portion to accommodate said deadplate and allow at least partial rotation of said kay when inserted through said first keyhole, said blade portion being engageable with said deadplate to prevent actuation of said tumblers and slide lever if said key is inserted through said second keyhole.

2. The improved bit key lock of claim 1, and further comprising a second key that may be selectively inserted through either said first or second keyholes and having a blade portion adapted to engage said slide lever and tumblers, a notch being formed in the blade portion to accommodate said deadplate and allow at least partial rotation of said key when inserted through said second keyhole, said blade portion being engageable with said deadplate to prevent actuation of said tumblers and slide lever if said key is inserted through said first keyhole.

3. The improved bit key lock of claim 1, and further comprising a third key that may be selectively inserted through either said first or second keyholes and having a blade portion adapted to engage said slide lever and tumblers, a pair of notches formed in the blade portion to accommodate said deadplate and allow at least partial rotation of said key when inserted through either said first or second keyholes, one notch being located to accommodate said deadplate if said key is inserted through said first keyhole and the other notch being located to accommodate said deadplate if said key is inserted through said second keyhole.

4. The improved bit key lock of claim 1, said plurality of tumblers comprising a set of three, one tumbler being centered relative to key locating surfaces on said cover and mounting plate.

* * * * *

UNITED STATES PATENT OFFICE

CERTIFICATE OF CORRECTION

Patent No. 4,009,600 Dated March 1, 1977

Inventor(s) Maynard A. Boeckman and Richard M. Singer

It is certified that error appears in the above-identified patent and that said Letters Patent are hereby corrected as shown below:

Abstract, line 2, "position" should be "positioned";

Column 4, line 29, "kay" should be "key".

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*